United States Patent [19]

Nishida et al.

[11] 4,165,556

[45] Aug. 28, 1979

[54] METHOD FOR MANUFACTURING SUEDE-LIKE ARTIFICIAL LEATHERS

[75] Inventors: Takeshi Nishida, Ibaragi; Masao Morioka, Sabae; Tetsuro Ohta, Joyo; Yukio Yamakawa, Hofu, all of Japan

[73] Assignee: Kanebo, Ltd., Tokyo, Japan

[21] Appl. No.: 854,806

[22] Filed: Nov. 25, 1977

Related U.S. Application Data

[62] Division of Ser. No. 745,851, Nov. 29, 1976, Pat. No. 4,073,988, which is a division of Ser. No. 546,873, Feb. 4, 1975, abandoned.

[30] Foreign Application Priority Data

Feb. 8, 1974 [JP] Japan ..... 49-16429
Dec. 18, 1974 [JP] Japan ..... 49-146170

[51] Int. Cl.[2] ..... B29H 7/18

[52] U.S. Cl. ..... 28/162; 264/147; 264/171; 428/91; 428/904

[58] Field of Search ..... 428/91, 904; 427/246, 427/210, 353, 412, 508; 264/49, 147, 171, 162; 28/162

[56] References Cited

U.S. PATENT DOCUMENTS

| | | | |
|---|---|---|---|
| 3,117,362 | 1/1964 | Breen | 264/171 X |
| 3,117,906 | 1/1964 | Tanner | 264/171 X |
| 3,282,721 | 11/1966 | Iseki et al. | 428/91 |
| 3,496,001 | 2/1970 | Minobe et al. | 428/904 X |
| 3,565,670 | 2/1971 | Shinohara et al. | 427/246 |
| 3,627,567 | 12/1971 | Tensho | 428/91 |
| 3,676,206 | 7/1972 | Nishitani et al. | 428/904 |
| 3,723,161 | 3/1973 | Fleissner | 427/337 |
| 3,966,865 | 6/1976 | Nishida et al. | 264/171 |

*Primary Examiner*—Lorraine T. Kendell
*Attorney, Agent, or Firm*—Blanchard, Flynn, Thiel, Boutell & Tanis

[57] ABSTRACT

Natural suede-like artificial leathers are manufactured by subjecting pile fibrous structures wherein at least the pile portion is composed of separatable composite filaments made by bonding different polymers having mutual low adhesive affinity with each other, the cross-section of which is constituted of a radial segment (A) and segments (B) complementing the radial segment or a radial segment (A), segments (B') corresponding to said radial segment and having wedge-shaped concave portions directing to the center and wedge-shaped segments (C) complementing said concave portions, to at least one of a heat treatment and a swelling treatment to shrink said fibrous structure at least 10% in the area, impregnating or coating said fibrous structures with a synthetic polymer solution or emulsion, coagulating said polymer solution or emulsion, drying the thus treated pile fibrous structure and then buffing said piles to raise naps.

15 Claims, 22 Drawing Figures

METHOD FOR MANUFACTURING SUEDE-LIKE ARTIFICIAL LEATHERS

This is a division of application Ser. No. 745,851 filed Nov. 29, 1976, now U.S. Pat. No. 4,073,988, which in turn is a division of Ser. No. 546,873, filed Feb. 4, 1975, now abandoned.

The present invention relates to a method for manufacturing natural suede-like artifical leathers having natural suede-like appearance and touch (feel) and having more excellent properties than natural suede.

Heretofore, a variety of attempts for manufacturing suede-like artificial leathers by applying a synthetic resin solution on a pile fabric or a flocked cloth composed of a woven fabric or a knitted fabric or impregnating said cloth with the above described resin solution have been made but products comparable to natural suedes in appearance and feel have not been obtained. Alternatively, it has been attempted that a non-woven fabric is impregnated with a synthetic resin solution and then raised to manufacture a suede-like artificial leather but also in this case the product has not been satisfactory in appearance and feel and further it has been poor in strength and been very inferior to natural suede in sewability and durability. These defects are based on the following reasons. In the former process, the shape of naps is controlled by the texture of the knitted fabric or the woven fabric and consequently the appearance becomes too uniform or the form of the substrate texture (knitted pattern of the substrate fabric or woven pattern of the substrate fabric) is apparent. In the latter process, it is difficult to fully entangle or bond the fibers with each other.

The first object of the present invention is to provide natural suede-like artificial leathers having the appearance and touch (feel) of natural suede and having more excellent properties (mechanical) properties, durability and the like) than natural suede and a method for manufacturing such products.

The second object of the present invention is to provide suede-like artificial leathers in which the surface naps are composed of very fine fibrils and the nap density is high and which has excellent appearance and luster and a noticeable chalk mark property and a method for manufacturing such products.

The term "chalk mark property" used herein means the inherent effect of natural suede that when the nap surface is touched with a finger, the naps uniformly lay in a constant direction and as a result the reflection direction of light varies and the touched trace remains on the surface and is visible.

The first aspect of the present invention consists in natural suede-like artificial leathers, which consist of a substrate fabric having a knitted texture or a woven texture mainly formed of separatable composite filaments composed of different polymers having mutual low adhesive affinity, the cross-section of which is constituted of radial segments (A) and segments (B) complementing the radial segments or a radial segments (A), segments (B') corresponding to said radial segments and having wedge-shaped concave portions directed to the center and wedge-shaped segments (C) complementing said concave portions, and a large number of very fine naps projecting from said substrate and connected to said substrate, said naps being constituted of fibrils of each segment of the above described cross-section of the composite filaments, and the spaces between fiber bundles constituting said knitted texture or woven texture and the spaces at lower portions of the naps being a least partially filled with substantially microporous synthetic polymer.

The second aspect of the present invention consists in a method for manufacturing natural suede-like artificial leathers in which a pile fibrous structure wherein at least the pile portion is composed of separatable composite filaments made by bonding different polymers having mutual low adhesive affinity with each other, the cross-section of which is constituted of radial segments (A) and segments (B) complementing the radial segments or radial segments (A), segments (B') corresponding to said radial segments and having wedge-shaped concave portions directed to the center and wedge-shaped segments (C) complementing said concave portions, is subjected to at least one of a heat treatment and a swelling treatment to shrink said fibrous structure at least 10% in the area, is impregnated or coated with a synthetic polymer solution or emulsion and said polymer solution or emulsion is coagulated and then the thus treated pile fibrous structure is dried and after which said piles are buffed to raise naps.

The term "separatable composite filaments, the cross-section of which is constituted of radial segments (A) and segments (B) complementing the radial segment" used herein means the composite filaments having the cross-sections as shown in FIGS. 1–4.

The term "radial" used herein means the shape radiating in at least three directions from the center of the cross-section and includes, for example, the cross form as shown in FIGS. 1, 2, 6, 9, 10-A, 11-A, 15-A, and 18-A, the Y form as shown in FIGS. 4, 5, 8, 13, 14 and 17-A and the radial form as shown in FIGS. 3, 7, 12-A and 16-A.

The term "segments complementing the radial segment" means the segments extending between two adjacent branches of said radial segment as in wedge shape or sector shape shown by B in FIGS. 1–3 and FIGS. 10–13 and is distinguished from "segments corresponding to the radial segment and having a concave portion of wedge shape directed to the center" as B' of FIGS. 5–9.

The term "separatable composite filaments in which a radial segment (A), segments (B') corresponding to said radial segment and having wedge-shaped concave portions directed to the center and segments (C) complementing said concave portions are bonded" means the composite filaments having the cross-sections as shown in FIGS. 5–9. The term "segments corresponding to the radial segment and having wedge-shaped concave portions directed to the center" means the segments having a concave portion of a wedge shape in which the point of the wedge shape is substantially directed to the center of the cross-section as shown in B' of FIGS. 5–9 and FIGS. 14–18.

The term "wedge-shaped segments complementing said concave portions" means the ones of wedge shape corresponding to the shape of the concave portion in the segment (B') as shown in C of FIGS. 5–9 and FIGS. 14–18.

The cross-sectional structure of said composite filaments is as mentioned above but the shape of the cross-section may be any form of circular and non-circular forms as shown in FIGS. 8 and 9.

The above described "segments" mean the portions constituting the cross-section of said composite filaments. The shape of the segments is "substantial" but the term "substantially" is omitted in convenience.

The "composite filament" is referred to as "conjugate filament".

In the composite filaments present in the pile portion or the substrate portion of the pile fibrous structure of the present invention, one of the different polymers having the mutual adhesive affinity (adhesive strength) constitutes the segment (A) or the segment (A) and the segment (C) and another polymer constitutes the segment (B) or the segment (B') and both the polymers are bonded with each other, so that when a heat treatment, a swelling treatment or a buffing treatment is effected, the composite filaments are readily separated (fibrillated) into the individual segments through chemical stimulation, physical stimulation or mechanical stimulation. Therefore, the composite filaments are referred to as "separatable composite filaments".

For example, when the cross-sectional structure of the separatable composite filament is as in FIG. 1, said composite filament is separated into segments A an B as in FIG. 10, when said structure is as in FIG. 2, said composite filament is separated into segments A and B as in FIG. 11, when said structure is as in FIG. 3, said composite filament is separated into segments A and B as in FIG. 12, when said structure is as in FIG. 4, said composite filament is separated into segments A and B as in FIG. 13, when said structure is as in FIG. 5, said composite filament is separated into segments A, B' nd C as in FIG. 14, when said structure is as in FIG. 6, said composite filament is separated into segments A, B' and C as in FIG. 15 and when said structure is as in FIG. 7, said composite filament is separated into segments A, B' and C as in FIG. 16.

As the combination of different polymers having a low adhesive affinity, mention may be made of polyamides and polyesters, polyamides and polyolefins, polyesters and polyolefins, polyesters and polyacrylonitrile series polymers, polyamides and polyacrylonitrile series polymers and the like.

Among them, the combination of polyamides and polyesters is the most preferable, because it is the most excellent in feel, luster and the like of the resulting suede-like artificial leathers.

In the case of the combination of the different polymers of a polyamide and a polyester and the like, it is the most preferable that the polyamide constitutes the radial portion (segment A), because said segment readily separates and shrinks.

As polyamides, for example, mention may be made of polycapramide, polyhexamethyleneadipamide, nylon-4, nylon-7, nylon-11, nylon-12, nylon-6-10, poly-m-xylyleneadipamide, poly-p-xylyleneadipamide and the like.

As polyesters, for example, mention may be made of polyethylene terephthalate, copolymers of polyethylene phthalate, polytetramethylene terephthalate, polyethylene oxybenzoate, 1,4-dimethylcyclohexane terephthalate, polypivalolactone and the like.

As polyolefins, for example, mention may be made of polyethylene, polypropylene and the like.

If the conjugate ratio of each segment constituting the cross-section of the composite filaments is shown by the area ratio of the segment A (radial segment), when the composite filaments are constituted of the segments A and B, said area ratio is 10–50%, preferably 15–30% and when the composite filaments are constituted of the segments A, B' and C, said area ratio is 10–30%, preferably 15–30%. The area ratio of the segment C (the total area ratio of the segment C) is 5–40%, preferably 10–25%. In this case, when the area ratio of the segment A is less than 10%, the radial portion becomes a very thin layer and the stability of the cross-sectional shape lowers, while when said ratio is more than 50%, the monofilament denier of the separated segment A becomes too large and further the difference of fineness from the segment B or the segments B' and C becomes larger and the appearance and feel of the resulting product are liable to be deteriorated.

The composite filaments present in the pile portion and the substrate portion of the pile fibrous structure of the present invention are separated into more than 4 segments including one radial segment (in FIGS. 1 and 2, 5 segments; in FIGS. 3 and 5, 7 segments; in FIG. 4, 4 segments; in FIG. 6, 9 segments; in FIG. 7, 13 segments) with a heat treatment and/or a swelling treatment and a buffing treatment to form a large number of naps composed of very fine fibrils and to form a large number of fine spaces in the inner portion of the fiber bundles constituting the substrate fabric, whereby a very excellent appearance, a very soft touch and an excellent chalk mark property are provided.

These unique functional effects can be obtained due to the formation of a large number of very fine fibrils having unique cross-sectional structures of the radial segments (segment A) and the like and have never been seen in conventional known composite filaments.

Particularly, the composite filaments wherein the radial segment is fine and the segment number is large as in the composite filaments of FIGS. 2 and 3 and in the composite filaments constituted of the radial segment (segment A), L-shaped segments (segment B') and wedge-shaped segments (segment C), form a large number of fine fibrils and are apt to form fine spaces in the very fine naps and the substrate and the appearance, chalk mark property, feel, vapor permeability and moisture permeability are excellent and such composite filaments are the most preferable.

Even if the previously known composite filaments wherein the radial segments are not present in the cross-sectional structure (for example, side-by-side type composite filaments) are separated, it is difficult to form a large number of very fine fibrils and such composite filaments form the products poor in the appearance, feel and chalk mark property.

According to the study of the inventors, as the number of naps covering the surface of the artificial leather product is larger and the fineness of the naps is smaller, the appearance and feeling are improved and the fineness is less than 1 denier (1–0.05 d), preferably less than 0.5 denier (0.5–0.05 d), more particularly less than 0.3 denier (0.3–0.05 d).

The length of the naps is 0.2–3.0 mm, preferably 0.5–2.0 mm.

The naps presen on the surface of the product of the present invention are composed of the fine fibrils formed through separation of the composite filaments, and further the fiber bundles constituting the texture of the substrate fabrics contain many fine fibrils of each segment forming the composite filaments and there are a large number of fine spaces between the segment fibrils, so that the substrate portion is excellent in the flexibility, elasticity and vapor permeability. The spaces between the mutual segments present in the substrate texture promote the improvement of the flexibility, feel and touch of the product. These spaces are more and larger, as the radial number of the radial segments is larger and the number of the segments is larger.

In the product of the present invention, the spaces between the fiber bundles constituting the knitted fabric or the woven fabric of the substrate and the spaces of the lower portion of the naps are at least partially and substantially adhered and filled with a synthetic polymer, such as polyurethane. Consequently, the mechanical properties of the product are excellent to the same extent as in natural suede and the sweat resistance and alkali resistance are good and the durability is high. Furthermore, the synthetic polymers of the elastomer and the like are substantially porous, so that these polymers provide moderate elasticity, vapor permeability and moisture permeability to the product and contribute to the flexible feel and the soft touch.

A large number of naps composed of the above described very fine fibers are distributed on the surface of the product of the present invention and cover the surface of the substrate and the cross-sectional shape of these very fine fibers shows the radial shape and the wedge shape or the radial shape, the L-shape and the wedge shape, which easily reflect light. Therefore, a moderate luster and an excellent chalk mark property can be provided and the resulting product shows a high grade appearance and is provided with the very soft touch and the flexible feel similar to natural suede leather. Furthermore, the naps are very fine fibers composed of synthetic polymers, such as polyamide, polyester and the like and further latently connect to the fibers constituting the texture of the substrate fabric and consequently are strong against abrasion and the product of the present invention is much more excellent in the durability than the flocked fabric. In the inner portion of the fiber bundles constituting the texture of the substrate, which connect to the naps, spaces are formed in such a state that the above described segments are separated, so that the substrate itself is flexible and elastic and these spaces improve the feeling of flexibility of the product.

Between the fiber bundles constituting the texture of knitted fabric or the woven fabric of the substrate and in the spaces of the lower portion of the naps, the elastic polymer substantially fills and forms the continuous cellular structure, so that the product is excellent in the mechanical properties, vapor permeability and moisture permeability and such a structure contributes to the soft touch of the product.

Such properties and functional effects of the product of the present invention can be attained only by the combination of the above described essential features.

A detailed explanation will be made with respect to the method for manufacturing the suede-like artificial leathers of the present invention hereinafter.

The pile fibrous structures to be used in the method of the present invention include pile woven fabrics (pile fabrics obtained by weaving pile as the texture, for example, velvet, velours, velveteen, corduroys), raised woven fabrics (for example, flannel, flano and the like), pile knitted fabrics (fabrics obtained by knitting piles as the texture, for example, pile knitted tricot, pile circular knitted fabric), raised knitted fabrics (for example, raised tricot, raised circular knitted fabric) and the like.

Among them, the knitted fabrics are preferable in view of maintenance of moderate stretchability in the product and particularly, the raised tricot is excellent in the grade and mechanical properties of the product, so that the raised tricot is most preferable.

The texture of the substrate fabric supporting (connecting to) the piles of the pile fibrous structure naturally connects to the pile yarns and further is partially constituted of the pile yarns, so that the texture of the substrate is also constituted of the composite filaments. The other fibers constituting the substrate (for example, back bar yarns in the raised tricot or weft and warp in the pile fabric) may be composed of any one of the composite filaments and the other fibers (for example, polyester, nylon, acrylic fibers, natural fibers).

Of course, if the composite filaments are used for all the fibers to constitute the texture of the substrate, the feeling of the resulting product becomes very flexible and when the other fibers are used, the resilient product can be obtained. When the composite filaments are used in an amount of more than 30%, the high degree of the leather-like feeling can be maintained and this is one of characteristics of the present invention.

The piles of the pile fibrous structures to be used in the present invention may be any one of the loop form and the cut piles in the top. The length of the piles is 0.5–4.0 mm, preferably 1–3 mm. When this length is less than 0.5 mm, the naps of the resulting artificial leather are too short and the woven pattern or the knitted pattern of the substrate fabric is readily seen and the chalk mark property is poor. When the length is more than 4.0 mm, the naps of the resulting artificial leather become too long and the suede-like feeling cannot be obtained. Furthermore, the naps are apt to be entangled with one another and the appearance and the chalk mark property lower. When the texture is the pile knitted fabrics or the pile woven fabrics which are obtained by knitting or weaving piles, such a texture may be formed by knitting or weaving as mentioned above, while in the case of the raised knitted fabrics or the raised woven fabrics, it is desirable to previously raise fully piles and adjust the length of the piles within the above described range.

The most preferable pile fibrous structures to be used in the present invention are the raised tricot and particularly various excellent effects can be developed but in order to adjust the length of the piles as described above, it is preferable to use raised tricot satins. The term "tricot satins" used herein means, for example, tricot fabrics having the front stitches as shown in FIGS. 19–21.

As the back stitch, the stitch as shown in FIG. 22 is usually adopted, but in both the front stitch and the back stitch, the opened laps can naturally be used other than the closed laps as shown in these Figures.

As the filaments for the back stitch, any filaments may be used but in general, when the composite filaments are used for the back stitch, the feeling of the resulting suede-like artificial leather is very rich in the flexibility and when the composite filaments are used together with polyester filaments or nylon filaments, the products having a moderate resiliency can be obtained.

The fineness of the composite filaments to constitute the front yarns is preferred to be 30–80 deniers and the fineness of the filaments to constitute the back yarns is preferred to be somewhat smaller (for example, 15–50 deniers) than that of the filaments for the front yarns.

One characteristic of the method of the present invention consists in that the pile fibrous structure is permitted to shrink more than 10% and by such a means, the pile density is increased and consequently the nap density of the resulting artificial leather is increased and the product having a high grade and an excellent chalk mark property can be obtained. When said shrinkage is rendered to be more than 20%, the appearance is much more improved. However, when the shrinkage is more than 40%, the feeling is liable to become rigid, so that it is essential to adjust the sort of fiber and the fineness of monofilament to be used for the fibrous substrate and an amount of resin deposited.

The "area shrinking percentage" to be used herein is measured as follows.

$$\text{Area shrinkage percentage} = (S_o - S/S_o) \times 100$$

$S_o$: Original area of the pile fibrous structure prior to shrinking when said structure is extended on a plain surface.

S: Area after shrinking (prior to the following step, that is, prior to the impregnation with a synthetic polymer solution or emulsion).

Before the shrinking treatment, a heat treatment may be carried out at an appropriate temperature (about 100°-130° C.) under such a condition that the original fibrous structure is moderately stretched in order to uniformize the knitted fabric and the like. In this case, the above described shrinking percentage is calculated based on the area of the original fibrous structure prior to such a heat treatment under the stretched condition.

The shrinking processes include a heat treatment under a relax state, a heat treatment in hot water or a swelling shrinkage of polymers constituting the composite filaments by means of chemicals. In the dry heat treatment, a large shrinkage may not be obtained, but in such a case, it is preferable to effect the heat treatment after water is applied. Among the heat treatments, the heat treatment in hot water is preferred, because the shrinking percentage can be easily adjusted by temperature and time. In this treatment, the composite filaments can be fibrillated to a fair degree concurrently with the shrinkage.

A combination of the above described swelling shrinkage of the composite filaments by means of chemicals with the heat treatment can easily effect the shrinkage and at the same time the composite filaments can be substantially fibrillated, so that this process is the most preferable one.

The swelling and shrinking chemicals to be used for the chemical treatment are an aqueous solution or emulsion of benzyl alcohol, phenol, dimethylformamide, nitrobenzene, o-chlorophenol, xylene, toluene, benzene and the like. Upon use, these chemicals are conveniently selected considering the swelling ability of the polymers to constitute the composite filaments. It is possible to adjust the shrinkage by selecting the concentration and the treating temperature. The treating temperature is higher than 5° C., preferably 10°-120° C. and the concentration of the chemicals is more than 0.1%, preferably more than 1%.

In order to make th appearance and feeling similar to those of natural leather, a solution or emulsion containing a synthetic polymer is applied or impregnated on the pile fibrous structure.

As said synthetic polymers, for example, mention may be made of polyurethanes, polyamide series polymers, vinyl chloride series polymers, acrylic polymers, acrylonitrile-butadiene series rubbers (NBR), styrene-butadiene series rubbers (SBR) and the like and these polymers may be used alone or in admixture. Among them, the elastomers, such as polyurethane, SBR, NBR and the like, are particularly preferable. If necessary, cross-linking agents, coloring agents, fillers, light proofing agents and the like may be admixed. Processes for applying the liquid containing the polymer on the pile fibrous structure include immersing, coating, spraying and the like. The amount of the polymer deposited is 3-40% by weight, preferably 5-30% by weight, more particularly 10-25% by weight based on the weight of the pile fibrous structure. When the amount is less than 3% by weight, the elasticity as an artificial leather is poor and the feeling becomes paper-like and further when the amount becomes larger than 40% by weight, the flexibility is poor and the feeling becomes rubber-like.

The coagulation of the coated or impregnated synthetic polymer is effected by the following manners. The thus treated pile fibrous structure is heated at a temperature of 60°-150° C. to evaporate the solvent (referred to as "dry coagulating process"). Alternatively, the coated or impregnated polymer is immersed in a coagulation bath to coagulate the polymer or is contacted with steam or moisture to gel the polymer and then washed with water to remove the solvent and then dried (referred to as "wet coagulating process").

In order to provide uniform and very fine cells to the coagulated resin and to provide flexibility, the wet coagulating process is preferable. As the coagulation bath to be used for the wet coagulation, use may be made of water, a mixed solution of water and dimethylformamide, an aqueous solution of an inorganic salt (NaCl, $Na_2SO_4$, $(NH_4)_2SO_4$, etc.) and the like.

The temperature of the coagulation bath is 10°-90° C., preferably 30°-70° C.

After the coagulation, it is desirable that the thus treated pile fibrous structure is washed with water (by flowing water in a water tank) to remove the solvent of the polymer and then dried.

The coagulated synthetic polymer forms a large number of very fine cells in the inner portion, so that the moisture permeability is excellent. The polymer is deposited between the fiber bundles constituting the knitted fabric or the woven fabric, to which the piles (naps) connect, or on the spaces at the lower portion of the piles, so that the moderate elasticity and feeling can be provided and the fabric can be stabilized and strengthened.

In the method of the present invention, when a water soluble polymer solution is impregnated or coated and then dried before the above described synthetic polymer solution or emulsion is impregnated or coated, the water soluble polymer is dissolved or removed in the coagulation bath or the water washing step and the fine spaces are formed between the above described porous polymer and the fibers and the tight adhesion between the polymer and the fibers is prevented and the touch and feel of the product is further improved. As the water soluble polymers, mention may be made of polyvinyl alcohol, carboxylmethyl cellulose, gelatin, starch, methyl cellulose and the like. The used amount thereof is 3-30% by weight based on the weight of the fibrous structure.

In order to deform the piles of the pile fibrous structure into naps, the pile surface is buffed. The buffing is effected by a roll wound with a wire card clothing or a roll wound with a polishing paper, such as sand paper or a polishing cloth, such as sand cloth. The buffing is sufficient in such a degree that the piles are uniformly deformed into naps. This point is considerably different from the case where the surface of the porous polymer layer is buffed to open the honey-comb-shaped cells as in the conventional suede-like synthetic leather. Naturally, after or before each step, dyeing or softening treatment or a treatment with an antistatic agent may be carried out.

The suede-like artificial leathers obtained by the method of the present invention have an excellent appearance and chalk mark property, a good feeling, a satisfactory mechanical strength and an improved sewability. The excellent appearance and the high chalk mark property are based on the fact that the nap group covering the surface of the suede-like artificial leather has such a form that the naps composed of the fine fibrils having the radial cross-section, the wedge-shaped cross-section or the naps composed of the fine fibrils having the radial cross-section, the cross-section having a wedge-shaped concave and the wedge-shaped cross-section complementing the concave are uniformly mixed.

In the method of the present invention, the pile fibrous structure is shrunk more than 10% in the area, so that the texture becomes dense and by the buffing after the polymer has been applied, the naps are formed and the substrate is covered by naps of the very fine fibers of the above described fibrils, so that the knitted pattern or the woven pattern of the substrate fabric does not appear and the appearance becomes very excellent.

In general, if the texture is permitted to be dense, the feeling of the resulting artificial leather is apt to become coarse and rigid, while in the case of the present invention, the fibers constituting the artificial leather consist mainly of the fibrillated very fine fibers, so that even if the texture is permitted to be dense, the product does not become coarse and rigid and rather the appearance is improved by making the texture dense. In the suede-like artificial leathers according to the present invention, the substrate connecting to the piles forms a woven fabric or a knitted fabric, so that the mechanical properties (strength) and the sewability are more excellent than the artificial leather wherein the substrate consists of a non-woven fabric.

Furthermore, 3–40% by weight of the porous synthetic polymer is deposited, so that a moderate elasticity and moisture permeability and a suede-like feeling and touch are given and the woven fabric or the knitted fabric forms the stabilized artifical leathers.

For a better understanding of the present invention, reference is taken to the accompanying drawings, wherein.

The following examples are given for the purpose of illustration of this invention and are not intended as limitations thereof.

EXAMPLE 1

Figure 2:
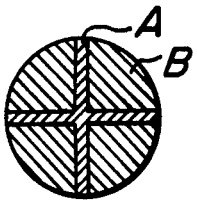
Figure 3:
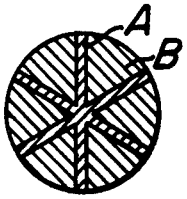
Figure 4:
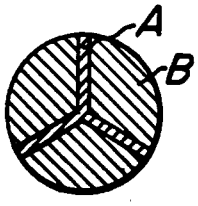

Nylon-6 (hereinafter abbreviated as 6 N) having an intrinsic viscosity of 1.14 in m-cresol at 30° C. and polyethylene terephthalate (hereinafter abbreviated as PET) having an intrinsic viscosity of 0.63 in o-chlorophenol at 30° C. were melted and conjugate spun in a conjugate ratio of 1:3 (volume ratio) and the spun filament was taken up on a bobbin at a rate of 700 m/min. to obtain a fibrillatable undrawn composite filament having substantially the same cross-section as shown in FIG. 2. In the spinning, 6 N and PET were conjugated spun so that 6 N formed the cross-shaped portion and PET formed the sector-shaped portion.

Figure 23:
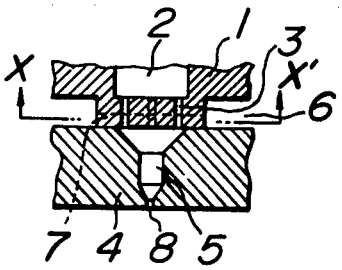
FIG. 23 is a vertical sectional view showing an embodiment of spinneret to be used for the manufacture of the composite filament having the cross-section as shown in FIG. 2.
Figure 24:
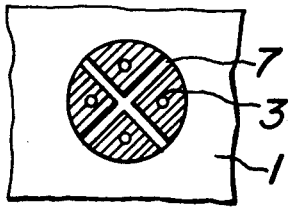
FIG. 24 is a cross-sectional view of the spinneret taken along a line X–X' in FIG. 23 in the arrow direction.

FIGS. 23 and 24 are enlarged views of one unit of a bonding portion of the two components and an orifice portion corresponding to the bonding portion in the spinneret used for the spinning of the filament. FIG. 23 is a vertical sectional view of the unit, and FIG. 24 is a cross-sectional view of the unit taken along a line X–X' in FIG. 23 in the arrow direction. In this spinneret, melted PET is flowed into a conduit 5 in a spinneret plate 4 from a supplying portion 2 of a distributing block 1 through four passages 3. While, melted 6 N is flowed into the conduit 5 in the spinneret plate 4 from a reservoir 6 formed by the distributing block 1 and the spinneret plate 4 through four ducts 7 arranged on the bottom surface of the distributing block 1, and is bonded with the PET while separating the PET into four segments, and the bonded flow is extruded through an orifice 8 to form a filament having a cross-section as shown in FIG. 2.

The above obtained undrawn filament was drawn to about 4 times its original length on a hot roller heated at 85° C., and the drawn filament was contacted with a hot plate heated at 150° C. and heat set to obtain 3 kinds of filaments $F_1$ of 70 d/14 f, $F_2$ of 50 d/14 $f_3$ and F, of 50 d/28 f, respectively.

Figure 19:
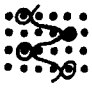
FIGS. 19–22 are the diagrammatical views showing the embodiments of the stitches of the tricot jersey fabrics to be used in the method of the present invention.
Figure 22:
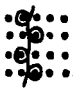

Each of the resulting 3 kinds of filaments, $F_1$, $F_2$ and $F_3$ and PET filament $F_4$ of 50 d/24 f, which was used as a comparative filament, was used as a back bar yarn and a front bar yarn, and knitted into a tricot fabric having stitches shown in FIGS. 19 and 22 by means of a tricot knitting machine. FIG. 22 shows the back stitch and FIG. 19 shows the front stitch.

Each of the resulting four kinds of tricot fabrics was fully raised by a wire card clothing raising machine, and the raised tricot fabric was subjected to the treatment described in the following Table 1 to separate the filament constituting the fabric into two components and to shrink the fabric. Then, the fabric was impregnated with a 10% by weight solution of polyester-type polyurethane in dimethylformamide (DMF), and squeezed in a squeezing percentage of 250% so that 25% by weight of the polyurethane was adhered to the fabric. The fabric was immersed in water at 40° C. to coagulate the polyurethane, washed with water and dried.

The fabric was buffed with a roll provided with No. 120 emery-paper to obtain an artificial leather.

Table 2 shows the appearance and feeling of the resulting artificial leather.

Table 1

| Sample No. | Filament | *Separation treatment and shrinking treatment | Shrinking percentage % Warp | Weft | Area | Remarks |
|---|---|---|---|---|---|---|
| 1-1 | $F_1$ | Not treated | 0 | 0 | 0 | Outside the present invention |
| 1-2 | $F_1$ | Treatment A followed by treatment D | 6 | 7 | 12.6 | Present invention |
| 1-3 | $F_1$ | Treatment B only | 7 | 9 | 15.4 | " |
| 1-4 | $F_1$ | Treatment C only | 10 | 13 | 21.7 | " |
| 2-1 | $F_2$ | " | 15 | 17 | 29.4 | " |
| 3-1 | $F_3$ | " | 14 | 18 | 29.5 | " |
| 4-1 | $F_4$ | Treatment D only | 5 | 7 | 9.6 | Outside the present invention |

Note:
Separation treatment A: A sample fabric is immersed in an aqueous emulsion containing 3% by weight of benzyl alcohol and 0.3% by weight of a surfactant at 40° C., and the temperature is raised to 80° C. in 30 minutes and further kept at 80° C. for 30 minutes, after which the sample is taken out from the emulsion, washed with water and dried in air.
Separation treatment B: The same treatment as treatment A, except that the concentration of benzyl alcohol is 5% by weight and the concentration of the surfactant is 0.5% by weight.
Separation treatment C: The same treatment as treatment A, except that the concentration of benzyl alcohol is 15% by weight and the concentration of the surfactant is 1.5% by weight.
Shrinking treatment D: A sample fabric is heat-treated at 180° C. for 10 minutes under a relaxed state.

Table 2

| Sample No. | Appearance and feeling of artificial leather | Remarks |
|---|---|---|
| 1-1 | Woven pattern of substrate appears. It is easily found out that the product is knitted good. Feeling is rigid, but touch is soft. | Outside the present invention |
| 1-2 | Woven pattern of substrate hardly appears. It is difficult to find out that the product is knitted good. The product has sheep suede-like feeling and touch. | Present invention |
| 1-3 | Woven pattern of substrate hardly appears. It is difficult to find out that the product is knitted good. The product has sheep suede-like feeling and touch. | Present invention |
| 1-4 | No woven pattern of substrate appears. It is impossible to find out that the product is knitted good. Feeling is flexible. The product has sheep suede-like feeling and touch. | Present invention |
| 2-1 | No woven pattern of substrate appears. It is impossible to find out that the product is knitted good. Feeling is very flexible. The product has sheep suede-like feeling and touch. | Present invention |
| 3-1 | No woven pattern of substrate appears. It is impossible to find out that the product is knitted good. Feeling is very much flexible The product has sheep suede-like feeling and touch. | Present invention |
| 4-1 | No woven pattern of substrate appears, but feeling is very rigid, and touch is coarse and hard. | Outside the present invention |

EXAMPLE 2

6 N having an intrinsic viscosity of 1.14 in m-cresol at 30° C. and PET having an intrinsic viscosity of 0.68 in o-chlorophenol at 30° C. were melted and conjugate spun in various conjugate ratio (volume ratio) shown in the following Table 3 by the use of several kinds of spinnerets described below, and the spun filaments were taken up on a bobbin at a rate of 710 mm/min to obtain undrawn filaments having a cross-section as shown in Table 3. The undrawn filaments were drawn in substantially the same manner as described in Example 1 to obtain filaments $F_5$, $F_6$, $F_7$, $F_8$, $F_9$ and $F_{10}$.

In the spinning of filament $F_5$, substantially the same spinneret as described in U.S. Pat. No. 3,188,689 was used.

In the spinning of filaments $F_6$, $F_7$ and $F_8$, substantially the same spinneret as used in Example 1 was used.

Figure 25:
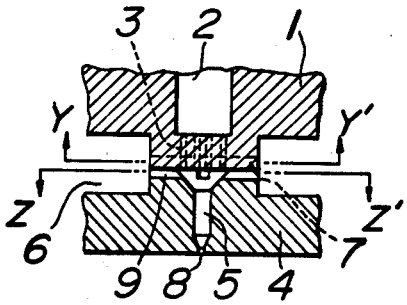
FIG. 25 is a vertical sectional view showing another embodiment of spinneret to be used for the manufacture of the composite filament having the cross-section as shown in FIG. 6.
Figure 26:
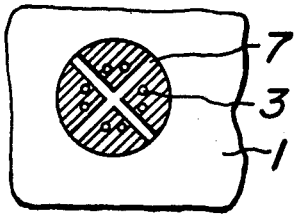
FIGS. 26 and 27 are cross-sectional views of the spinneret taken along lines Y–Y' and Z–Z' in FIG. 25 in the arrow direction, respectively.
Figure 27:
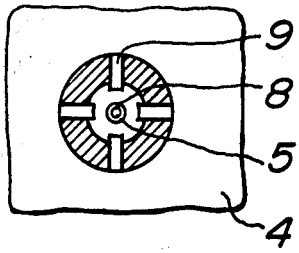

In the spinning of filaments $F_9$ and $F_{10}$, a spinneret having a unit of a bonding portion of two components and an orifice portion corresponding to the bonding portion shown in FIGS. 25, 26 and 27 was used. FIG. 25 is a vertical sectional view of the unit, and FIGS. 26 and 27 are cross-sectional views of the unit taken along lines Y–Y' and Z–Y' in FIG. 25 in the arrow direction, respectively. In the spinneret, melted PET is flowed into a conduit 5 in a spinneret plate 4 from a supplying portion 2 in a distributing block 1 through eight passages 3. While, melted 6 N is flowed into the conduit 5 in the spinneret plate from a reservoir 6 formed by the distributing block 1 and the spinneret plate 4 through four ducts 7 arranged on the bottom surface of the distributing block 1 and through four ducts 9 arranged on the back surface of the spinneret plate 4. The flows of 6 N from the ducts 7 are bonded with PET so that 6 N separates PET into four segments. Each of the flows of 6 N from the ducts 9 is bonded with each of the four segments of PET in the form of a wedge. Then, the bonded flow is extruded through an orifice 8 into air to form an undrawn filament having a cross-section as shown in FIG. 6.

Table 3

Figure 1:
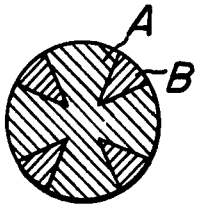
FIGS. 1–9 are the cross-sectional views of the composite filaments to be used in the method of the present invention.
Figure 6:
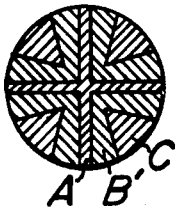

| Filament No. | Fineness (d/f) | Conjugate ratio of PET/6N (volume ratio) | Cross-sectional shape |
|---|---|---|---|
| $F_5$ | 50/25 | 1/1 | FIG. 1 |
| $F_6$ | 50/15 | 3/1 | FIG. 2 |
| $F_7$ | 50/25 | " | " |
| $F_8$ | 30/15 | " | " |
| $F_9$ | 50/25 | 2/1 | FIG. 6 |
| $F_{10}$ | 30/15 | " | " |

Filaments $F_5$–$F_{10}$ shown in the above Table 3, PET filament $F_4$ (50 d/24 f) used in Example 1, PET filament $F_{11}$ (30 d/12 f) and 6 N filament $F_{12}$ (30 d/10 f) were used as a back bar yarn and a front bar yarn in the combinations shown in the following Table 4 and knitted into tricot satins at a course number of 80/inch by means of a 28 gauge tricot knitting machine. The resulting tricot satins were fully raised by a wire card clothing raising machine to obtain raised tricot fabrics shown in Table 4. The width of the fabric was 270 cm before the raising, and was decreased to 95 cm after the raising.

Table 4

Figure 20:
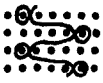
Figure 21:
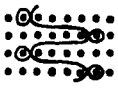

| Raised tricot fabric No. | Filament Back yarn | Filament Front yarn | Stitch Back | Stitch Front | Pile length (mm) |
|---|---|---|---|---|---|
| 5-1 | $F_{11}$ | $F_5$ | FIG. 22 | FIG. 19 | 1.1 |
| 6-1 | " | $F_6$ | " | " | 1.1 |
| 7-1 | " | $F_7$ | " | " | 1.2 |
| 7-2 | $F_8$ | " | " | " | 1.0 |
| 9-1 | $F_{11}$ | $F_9$ | " | " | 1.1 |
| 9-2 | $F_{11}$ | " | " | " | 1.1 |
| 9-3 | $F_{12}$ | " | " | " | 1.0 |
| 9-4 | $F_{11}$ | " | " | FIG. 20 | 1.7 |
| 4-1 | " | $F_4$ | " | FIG. 19 | 1.1 |

The raised tricot fabric shown in the above Table 4 was shrunk under the condition described in the following Table 5, washed with water and dried. The thus treated tricot fabric was immersed in a 15% by weight solution of polyester type polyurethane in DMF and squeezed in a squeezing percentage of 100%.

Table 5

| Sample No. | Raised tricot fabric No. | Heat treatment and/or chemical treatment | Area shrinking percentage (%) |
|---|---|---|---|
| 5-1-1 | 5-1 | 1 Condition A | 18 |
| 6-1-1 | 6-1 | Condition A | 14 |
| 7-1-1 | 7-1 | Immersed in hot water at 70° C. for 5 minutes | 7 |
| 7-1-2 | 7-1 | Immersed in boiling water for 5 minutes | 10 |
| 7-1-3 | 7-1 | Condition A | 12 |
| 7-1-4 | 7-1 | *2 Condition B | 20 |
| 7-2-1 | 7-2 | Condition B | 23 |

Table 5-continued

| Sample No. | Raised tricot fabric No. | Heat treatment and/or chemical treatment | Area shrinking percentage (%) |
|---|---|---|---|
| 9-1-1 | 9-1 | Condition B | 25 |
| 9-2-1 | 9-2 | Immersed in hot water at 70° C. for 5 minutes | 8 |
| 9-2-2 | 9-2 | Immersed in boiling water for 5 minutes | 10 |
| 9-2-3 | 9-2 | *3 Condition C | 15 |
| 9-2-4 | 9-2 | Condition A | 20 |
| 9-2-5 | 9-2 | Condition B | 38 |
| 9-3-1 | 9-3 | Condition B | 38 |
| 9-4-1 | 9-4 | Condition B | 22 |
| 4-1-1 | 4-1 | Condition C | 15 |

Note:
*1 Condition A: A sample fabric is immersed in a 3% by weight aqueous solution of benzyl alcohol at 40° C., heated to 80° C. in 20 minutes, and maintained at 80° C. for 20 minutes.
*2 Condition B: A sample fabric is immersed in a 15% by weight aqueous dispersion of benzyl alcohol, which contains 1.5% by weight of an emulsifier of a nonionic surfctant (addition product of nonylphenol to ethylene oxide), at 80° C. for 20 minutes.
*3 Condition C: A sample fabric is immersed in hot water at 90° C., heated to 130° C. in 1 hour, and maintained at 130° C. for 20 minutes.

Then, the above treated raised tricot fabric was immersed in water at 30° C. for 15 minutes to coagulate the polyurethane, washed thoroughly with water and dried. The amount of polyurethane solid adhered to the fabric was 15 parts by weight based on 100 parts by weight of the fiber. The thus obtained fabric was buffed by means of a roll provided with No. 120 emery-paper to obtain a suede-like artificial leather.

Physical properties, appearance and touch of the resulting suede-like artificial leather are shown in the following Table 6. For comparison, physical properties, appearance and touch of natural sheepskin suede are shown together in Table 6.

| Sample No. | Physical property: Average fineness of naps (denier) | Thickness (mm) | Apparent density (g/cm³) | Tensile strength (Kg/mm²) warp | Tensile strength (Kg/mm²) weft | Elongation (%) warp | Elongation (%) weft | Tear strength (Kg/mm) warp | Tear strength (Kg/mm) weft | Flexibility (g.cm) | Appearance | Touch | Chalk mark property | Remarks |
|---|---|---|---|---|---|---|---|---|---|---|---|---|---|---|
| 5-1-1 | 0.4 | 0.78 | 0.33 | 1.8 | 1.3 | 100 | 149 | 2.1 | 3.0 | 0.407 | o | o | o | Present invention |
| 6-1-1 | 0.7 | 0.78 | 0.32 | 1.7 | 1.3 | 95 | 145 | 1.8 | 2.8 | 0.433 | ◎ | o | o | " |
| 7-1-1 | 0.4 | 0.82 | 0.33 | 2.0 | 1.3 | 80 | 135 | 2.0 | 2.9 | 0.459 | * | o | o | Outside the present invention |
| 7-1-2 | 0.4 | 0.81 | 0.34 | 1.7 | 1.3 | 91 | 142 | 2.1 | 2.7 | 0.410 | ◎ | ◎ | o | Present invention |
| 7-1-3 | 0.4 | 0.81 | 0.34 | 1.8 | 1.1 | 101 | 139 | 2.0 | 3.0 | 0.382 | ◎ | ◎ | o | " |
| 7-1-4 | 0.4 | 0.78 | 0.35 | 1.9 | 1.3 | 110 | 144 | 1.8 | 3.1 | 0.313 | ◎ | ◎ | ◎ | " |
| 7-2-1 | 0.4 | 0.75 | 0.36 | 1.7 | 1.2 | 110 | 151 | 1.8 | 2.7 | 0.245 | ◎ | ◎ | ◎ | " |
| 9-1-1 | 0.2 | 0.70 | 0.40 | 1.9 | 1.3 | 115 | 170 | 2.4 | 3.5 | 0.315 | ◎ | ◎ | ◎ | " |
| | | | | | | | | | | | | | | Outside |

5. Chalk mark property
The surface of a sample substrate is slightly rubbed by finger along the direction, to which naps are inclined (in general, buffing direction), and a light of an incandescent lamp is irradiated on an area of 1 cm² of the sample substrate from the rectangular direction (from just above the sample), and the reflectivity of the light in the direction inclined by 45° from the irradiation direction is meaured, from the direction against the rubbing direction, which is $I_o$. Then, the sample substrate is slightly rubbed by finger against the inclining direction of naps, and the reflectivity of the light is measured in the same manner, which is $I_1$.
Then, the difference (ΔI) of the reflectivities is calculated by the following formula.

$$\Delta I(\%) = \left| \frac{I_1 - I_0}{I_0 \text{ or } I_1} \right| \times 100$$

In the formula, the smaller value of $I_o$ and $I_1$ is used as the denominator.
As the value of ΔI(%) is larger, the chalk mark appears clearly. The chalk mark property is estimated by the following standard.
◎ Clearly appears ... ΔI is larger than 30%.
o Fairly clearly appears ... ΔI is 30–15%.
o Somewhat appears ΔI is 15–5%.
* Hardly appears ... ΔI is smaller than 5%.

It can be seen from Table 6 that the suede-like antificial leathers produced by the method of the present invention are very excellent in the various physical properties, feeling, appearance and touch, and are similar to natural sheepskin suede. Particularly, the artificial leather of sample No. 9-4-1 had naps longer than the other artificial leathers and had a splendid natural leather-like appearance.

From the observation of the surface and cross-section of the resulting artificial leathers (except sample No. 4-1-1) by means of a scanning type electron microscope, it was ascertained that naps on the surface were composed of 6 N fine fibrils having a cross-shaped cross-section and PET fine fibrils having a sector-shaped cross-section and complementing the cross-shape of 6 N, or composed of 6 N fine fibrils having a cross-shaped cross-section and a wedge-shaped cross-section and PET fine fibrils having a cross-section having a wedge-shaped concave. Further, it has ascertained that, particularly in sample Nos. 5-1-1, 6-1-1, 7-1-3, 7-1-4, 7-2-1, 9-1-1, 9-2-4, 9-2-5, 9-3-1 and 9-4-1, the composite filament in the substrate also was fairly separated into fibrils (more than 30%) having the above described cross-sectional shapes.

The average length of naps in each sample was 0.8–1.0 mm. However, in sample No. 9-4-1, the average length was 1.2 mm. Further, it was ascertained that the polyurethane resin adhered to the substrate had a porous structure.

For comparison, a side-by-side type composite filament of 50 d/24 f prepared from the above described 6 N and PET was used as a front yarn, and the PET filament $F_{11}$ was used as a back yarn, and knitted into a tricot fabric having a front stitch shown in FIG. 19 and a back stitch shown in FIG. 22. The tricot fabric was treated under substantially the same condition as that in the production of the artificial leather of sample No. 7-1-4 to prepare an artificial leather. However, in this case, the card wire raising was not able to be carried out smoothly, and piles of the raised tricot fabric were twisted. Moreover, in the resulting artificial leather, naps had coarse and hard touch and rigid feeling, and the nap density was very uneven. Therefore, the artificial leather was very poor in the touch, feeling and appearance.

EXAMPLE 3

Figure 28:
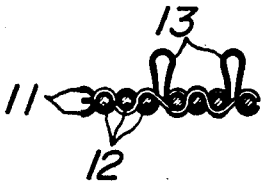
FIG. 28 is a cross-sectional view showing an embodiment of velvet fabric to be used in the method of the present invention.

Composite filament $F_9$ produced in Example 2 was used in the following manner, and knitted into a velvet having a cross-sectional weave as shown in FIG. 28.

| | | |
|---|---|---|
| Warp | in the substrate (numeral 11 in FIG. 28) | $F_9$ |
| Weft | in the substrate (numeral 12 in FIG. 28) | $F_9$ |
| Yarn | for pile (numeral 13 in FIG. 28) | three-ply filament (150 d/75 f) of $F_9$ |
| Pile | length | 2.0 mm |

The resulting velvet was subjected to a shrinking treatment under various conditions described in the following Table 7, and each of the shrunk velvet was subjected to impregnation with polyurethane, buffing and the other treatments in the same manner as described in Example 2 to obtain suede-like artificial leathers.

Table 8 shows physical properties, appearance, and touch of the resulting artificial leathers.

It can be seen from Table 8 that the suede-like artificial leather produced in the present invention is remarkably excellent in the physical properties, feeling and appearance.

Further, it was ascertained from the observation of the surface of the resulting artificial leather (by means of a scanning type electron microscope) that naps on the surface were composed of 6 N fine fibrils, which had a cross-shaped cross-section and a wedge-shaped cross-section, and of PET fine fibrils, which had a cross-section having a wedge-shaped concave, and particularly in sample No. 10-1-3, about 60% of the composite filaments in the substrate was separated into fibrils having the above described cross-sections.

In each of the samples, the average length of naps was 1.0–1.2 mm.

Table 7

| Sample No. | Chemical treatment condition | Area shrinking percentage (%) |
|---|---|---|
| 10-1-1 | Immersed in hot water at 70° C. for 5 minutes | 6 |
| 10-1-2 | Immersed in boiling water for 5 minutes | 12 |
| 10-1-3 | Condition B in Example 2 | 21 |

Table 8

| Sample No. | Thickness (mm) | Apparent density (g/cm$^3$) | Flexibility (g . cm) | Appearance | Touch | Chalk mark property |
|---|---|---|---|---|---|---|
| 10-1-1 | 0.72 | 0.29 | 0.35 | • | o | o |
| 10-1-2 | 0.73 | 0.34 | 0.39 | ◎ | ◎ | ◎ |
| 10-1-3 | 0.73 | 0.35 | 0.31 | ◎ | ◎ | ◎ |

EXAMPLE 4

Composite filament F, produced in Example 2 was doubled twisting in S direction at a rate of 50 T/M to obtain a filament of 100 d/50 f. The resulting filament was knitted into a loop pile circular knitted fabric by means of a sinker pile knitting machine having a cylinder diameter of 30 inches and a gauge of 20 needles/inch. The pile length of the resulting pile circular knitted fabric was 2.5 mm.

The pile circular knitted fabric was subjected to a shrinking treatment under the conditions shown in the following Table 9, and the shrunk fabrics were subjected to impregnation with polyurethane and buffing in the same manner as described in Example 2 to obtain suede-like artificial leathers.

Table 10 shows physical properties, feeling and touch of the resulting artificial leathers. It can be seen from Table 10 that the suede-like artificial leather of the present invention is remarkably excellent in the physical property, feeling and touch.

In each of the artificial leathers the average length of naps was 1.8–2.0 mm.

Table 9

| Sample No. | Chemical treatment condition | Area shrinking percentage (%) |
|---|---|---|
| 11-1-1 | Immersed in hot water at 70° C. for 5 minutes | 8 |
| 11-1-2 | Immersed in boiling water for 5 minutes | 13 |
| 11-1-3 | Condition B in Example 2 | 24 |

Table 10

| Sample No. | Thickness (mm) | Apparent density (g/cm³) | Flexibility (g . cm) | Appearance | Touch | Chalk mark property |
|---|---|---|---|---|---|---|
| 11-1-1 | 0.74 | 0.28 | 0.250 | * | o | o |
| 11-1-2 | 0.72 | 0.30 | 0.248 | ◎ | ◎ | ◎ |
| 11-1-3 | 0.72 | 0.32 | 0.238 | ◎ | ◎ | ◎ |

Further, the loop pile of the above obtained loop pile circular knitted fabric was sheared into a pile length of 2.0 mm, and then the pile fabric was subjected to a shrinking treatment and the other treatments under substantially the same condition as that in the above artificial leather of sample No. 11-1-3 to obtain a suede-like artificial leather (sample No. 11-2-1).

The resulting artificial leather of sample No. 11-2-1 had naps having a length of about 1.5 mm and had substantially the same physical properties as those of sample No. 11-1-3 shown in Table 10. However, the appearance of sample No. 11-2-1 was somewhat different from that of sample No. 11-1-3. That is, in sample No. 11-1-3, naps were present in the form of bundles and covered all over the substrate, while in sample No. 11-2-1, naps were separated into individual naps and covered all over the substrate.

EXAMPLE 5

Composite filament F, produced in Example 2 was used as a front bar yarn, and PET filament $F_{11}$ of 30 d/12 f was used as a back bar yarn, and knitted into a tricot satin (No. 12) having a front stitch as shown in FIG. 19 (open lapse) and a back stitch as shown in FIG. 22 in a course number of 75/inch by means of a 28 gauge tricot knitting machine.

The resulting tricot jersey fabric (No. 12) was raised fully by means of a card wire raising machine, and the raised fabric was immersed in an aqueous emulsion containing 15% by weight of benzyl alcohol and 3% by weight of a nonionic surfactant, squeezed in a squeezing percentage of 80%, immersed in hot water at 95° C. for 3 minutes, washed with water and dried. The area of the fabric was decreased by 23% in the above treatment.

The above treated fabric was immersed in a solution of polyester type polyurethane in DMF, squeezed, immersed in water at 30° C. for 20 minutes to coagulate the polyurethane, washed thoroughly with water and dried. In this treatment, the concentration of the polyurethane in the DMF solution and the squeezing percentage at the squeezing were varied, whereby the amount of the polyurethane to be adhered to the fabric was varied as shown in the following Table 11.

The fabric adhered with polyurethane was buffed in the same manner as described in Example 1 to obtain an artificial leather.

Physical properties of the resulting artificial leathers are shown in Table 11.

Table 11

| Sample No. | Amount of polyurethane adhered (%) | Physical property: Thickness (mm) | Apparent density (g/cm³) | Tensile strength (Kg/mm²) warp | Tensile strength (Kg/mm²) weft | Elongation (%) warp | Elongation (%) weft | Tear strength (Kg/mm) warp | Tear strength (Kg/mm) weft | *Recovery from 10% elongation (%) warp | *Recovery from 10% elongation (%) weft | Flexibility (g . cm) | Remarks |
|---|---|---|---|---|---|---|---|---|---|---|---|---|---|
| 12-3 | 3.0 | 0.69 | 0.31 | 1.4 | 1.0 | 125 | 181 | 2.0 | 2.5 | 81 | 82 | 0.221 | |
| 12-4 | 5.0 | 0.69 | 0.32 | 1.6 | 1.1 | 120 171 | 2.1 | 2.8 | 83 | 83 | 0.240 | | |
| 12-5 | 10.0 | 0.70 | 0.36 | 1.8 | 1.3 | 116 | 166 | 2.2 | 3.2 | 85 | 86 | 0.252 | Present invention |
| 12-6 | 25.0 | 0.71 | 0.41 | 2.0 | 1.6 | 91 | 148 | 2.8 | 3.9 | 89 | 90 | 0.270 | |
| 12-7 | 30.0 | 0.72 | 0.44 | 2.3 | 1.8 | 85 | 139 | 3.0 | 4.1 | 91 | 91 | 0.281 | |
| 12-8 | 40.0 | 0.73 | 0.47 | 2.6 | 2.0 | 83 | 132 | 3.2 | 4.2 | 92 | 92 | 0.289 | |
| 12-1 | 0 | 0.68 | 0.31 | 1.0 | 0.6 | 138 | 232 | 1.5 | 2.0 | 67 | 70 | 0.196 | Outside the present |
| 12-2 | 2.0 | 0.68 | 0.31 | 1.1 | 0.7 | 130 | 210 | 1.6 | 2.0 | 70 | 71 | 0.205 | |
| 12-9 | 45.0 | 0.74 | 0.50 | 3.2 | 2.3 | 70 | 112 | 3.8 | 5.0 | 98 | 99 | 0.368 | |
| Sheepskin suede | — | 0.85 | 0.50 | 2.2 | 2.0 | 68 | 75 | 1.5 | 1.8 | 87 | 87 | 0.258 | |

*Note:
The recovery from 10% elongation is the percentage of recovered length of a sample fabric when the sample fabric is elongated by 10%. The lower the value, the less elastic the fabric is, and the higher the value, the more elastic the fabric is, and the fabric has rubber-like feeling.

As seen from Table 11, the artificial leathers (sample Nos. 12-3, 12-4, 12-5, 12-6, 12-7 and 12-8), which are obtained by adhering 3–40% by weight of polyurethane to the raised tricot fabric after the heat treatment and/or chemical treatment by the method of the present invention, have physical properties similar to those of natural sheepskin suede and are excellent in the appearance and touch. However, when the adhered amount of polyurethane is less than 3% by weight (artificial leather sample Nos. 12-1 and 12-2), the artificial leathers are soft, but are poor in the strength and in the recovery from 10 elongation. That is, the artificial leathers have not a natural leather-like excellent feeling. While, when the adhered amount of polyurethane is more than 30% by weight (artificial leather sample No. 12-9), the artificial leather has a sufficiently high strength, but is poor in the flexibility and is high in the recovery from 10% elongation. That is, the artificial leather has rubbery feeling rather than natural leather-like touch.

EXAMPLE 6

Figure 7:
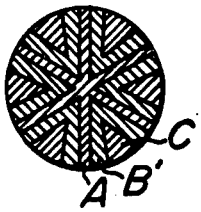
Figure 8:
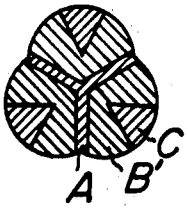
Figure 9:
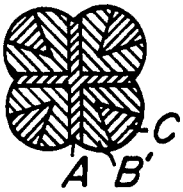
Figure 10:
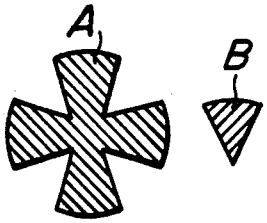
FIGS. 10–18 are the cross-sectional views of embodiments of the segments (fibrils) formed by separating (fibrillating) the composite filaments according to the present invention, in which A is the radial segment, B is the segment complementing the radial portion, B' is the segment having the wedge-shaped concave portion and C is the segment complementing the wedge-shaped concave portion.
Figure 11:
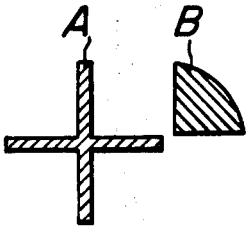
Figure 12:
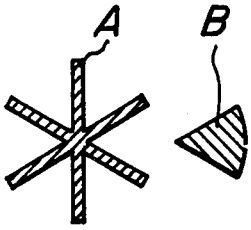
Figure 13:
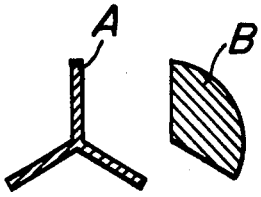
Figure 14:
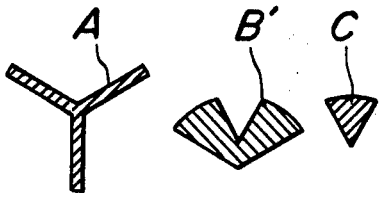
Figure 15:
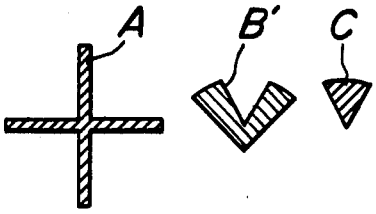
Figure 16:
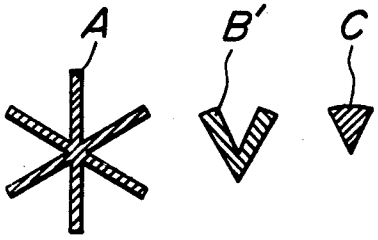

A composite filament of 50 d/25 f having a cross-section as shown in FIG. 7 was produced in substantially the same spinning method as that in composite filament F, of Example 2. In this spinning, nylon-66 (hereinafter abbreviated as 66 N) and PET were bonded so that 66 N would form radial segment (A) and wedge-shaped segment (C and PET would form segment (B') having a wedge-shaped concave, in the cross-section of the filament.

A spinneret similar to that shown in FIGS. 25, 26 and 27, wherein the number of distributing block ducts 7 and that of spinneret plate ducts 9 are 6 respectively, and the number of distributing block passages 3 is 12, was used.

The resulting composite filament was used as a front bar yarn and 66 N filament of 30 d/12 f was used as a back bar yarn, and these filaments were knitted into a tricot satin (No. 13) having a back stitch as shown in FIG. 22 and a front stitch as shown in FIG. 19 at a course number of 85/inch by means of a 28 gauge tricot knitting machine.

The resulting tricot satin was fully raised by a wire card clothing raising machine, immersed in an aqueous emulsion containing 15% by weight of benzyl alcohol and 2% by weight of an emulsifier (nonionic surfactant), squeezed in a squeezing percentage of 80%, immersed in hot water at 90° C. for 3 minutes to shrink the fabric. The area shrinking percentage of the fabric in this treatment was 32%.

The shrunk raised fabric was impregnated with NBR emulsion, and heated at 120° C. for 5 minutes to coagulate and dried the NBR (dry coagulation), whereby 22% by weight, based on the weight of the fabric, of the NBR in dry base was adhered to the fabric. Then, the raised surface of the fabric was buffed with a roll sander provided with No. 240 emery-paper to form naps. The naps were composed of fibrils consisting of the above described segments and had a length of 0.5–0.6 mm and an average fineness of 1.5 deniers.

The resulting suede-like artificial leather (sample No. 13-1) was dyed with a disperse dye in a conventional dyeing method and further dyed with an acid dye.

The resulting colored suede-like artificial leather had natural leather-like feeling, appearance and excellent chalk mark property, and further the artifical leather had deep graceful luster and color tone which are not possessed by natural leather.

EXAMPLE 7

Figure 5:
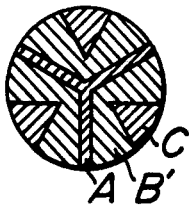

A tricot satin (No. 14) was produced in substantially the same manner as described in Example 6. However, in this Example 7, a composite filament $F_{15}$ having a cross-section similar to that shown in FIG. 5 was produced by using a spinneret shown in FIG. 25, wherein the number of distributing block ducts 7 and that of spinneret plate ducts 9 are 3 respectively, and the number of distributing block passage 3 is 6, and was used as a front bar yarn.

In the same manner as described in Example 6, the above obtained tricot satin was raised, subjected to a shrinking treatment and impregnated with the resin, and the raised surface was buffed.

Figure 17:
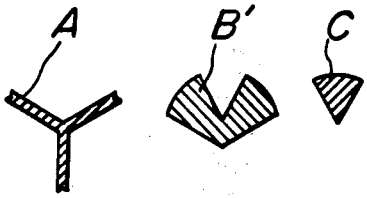
Figure 18:
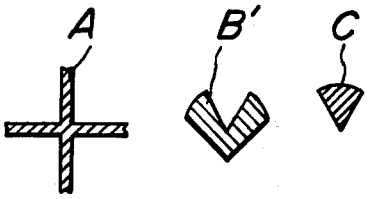

The area shrinking percentage in the above treatment was 28%, and the amount of the resin adhered to the fabric was 18% by weight based on the weight of the fabric. The naps were composed of fibrils consisting of segments having cross-sections as shown in FIG. 17, and had a length of 0.8 mm.

The resulting suede-like artificial leather (sample No. 14-1) was dyed in the same manner as described in Example 6.

The resulting colored suede-like artificial leather had a flexible feeling (flexibility 0.325), an elegant appearance and an excellent chalk mark property, and was quite similar to natural suede.

EXAMPLE 8

6 N and PET used in Example 2 were melted and conjugate spun in various conjugate ratios in the same manner as described in Example 2 by using a spinneret having a cross-section as shown in FIG. 25 to obtain composite filaments $F_{16}$-$F_{21}$ of 50 d/25 f having substantially the same cross-section as shown in FIG. 6. The conjugate ratios of component A:B':C in filaments $F_{16}$–$F_{21}$ are shown in the following Table 12.

Table 12

| Filament | Conjugate ratio (area) (%) Component A | Component B' | Component C |
|---|---|---|---|
| $F_{16}$ | 10 | 65 | 25 |
| $F_{17}$ | 15 | 60 | 25 |
| $F_{18}$ | 30 | 45 | 25 |
| $F_{19}$ | 50 | 30 | 20 |
| $F_{20}$ | 55 | 30 | 15 |
| $F_{21}$ | 25 | 65 | 10 |

Each of filaments $F_{16}$, $F_{17}$, $F_{18}$, $F_{19}$, $F_{20}$ and $F_{21}$ was used as a front bar yarn and PET filament $F_{11}$ of 30 d/12 f was used as a back bar yarn, and suede-like artificial leathers of the present invention were produced in substantially the same method as that in the case of artificial leather of sample No. 9-1-1 in Example 2.

All of the resulting artificial leathers (sample Nos. 16-1, 17-1, 18-1, 19-1, 20-1 and 21-1) had substantially the same physical properties as those of sample No. 9-1-1. However, the above obtained artificial leathers were different from each other in the appearance and touch as shown in the following Table 13.

Table 13

| Sample No. | Appearance and touch |
|---|---|
| 16-1 | Naps are relatively uniform and are elegant. Soft and smooth touch. |
| 17-1 | Naps are uniform and very elegant. Very soft and smooth touch. |
| 18-1 | Naps are uniform and very elegant. Very soft and smooth touch. |
| 19-1 | Naps are relatively uniform and are elegant. Soft and smooth touch. |
| 20-1 | Naps are ununiform (significantly large amount of thick naps). Somewhat coarse impression. Somewhat coarse and hard touch. |
| 21-1 | Naps are relatively uniform and are elegant. Soft and smooth touch. |

EXAMPLE 9

6 N used in Example 2 and polypropylene (trademark Noblen MA3A, made by Mitsubishi Yuka Co.) were melted and conjugate spun in a conjugate ratio of 3:1 (volume ratio) so that the polypropylene would form the cross-shaped portion by means of the same spinneret as used in Example 1. The resulting undrawn composite filament had substantially the same cross-section as shown in FIG. 2. The resulting undrawn filament was drawn to 3.8 times its original length on a hot pin at 60° C. to obtain a composite filament $F_{22}$ of 50 d/25 f.

The resulting filament $F_{22}$ was used as a front bar yarn, and PET filament $F_{11}$ of 30 d/12 f was used as a back bar yarn, and a suede-like artificial leather (sample No. 22-1) was produced in substantially the same method as that in the production of artificial leather of sample No. 9-2-2 in Example 2. However, the area shrinking percentage of the raised fabric in the shrinking treatment in the course of the production of sample No. 22-1 was 21%.

The thus obtained artificial leather was covered with very fine naps and had substantially the same flexibility, appearance and chalk mark property as those of natural suede.

It was found from the observation of naps of the resulting artificial leather by an electron microscope that naps were composed of fibrils having a cross-shaped cross-section and fibrils having a sector-shaped cross-section. The average length of naps was 1.1 mm and the average fineness thereof was 0.4 denier.

EXAMPLE 10

In the same manner as described in Example 4, a filament of 100 d/50 f, which was obtained by doubling 2 filaments $F_9$, was knitted into loop pile knitted fabrics having different pile lengths as shown in the following Table 14 by means of the same sinker pile knitting machine as used in Example 4.

Table 14

| Pile knitted fabric No. | Pile length (mm) |
|---|---|
| 22 | 0.3 |
| 23 | 0.5 |
| 24 | 1.0 |
| 25 | 3.0 |
| 26 | 4.0 |
| 27 | 4.5 |

In the same manner as described in Example 2, the pile knitted fabric Nos. 22, 23, 24, 25, 26 and 27 were immersed in the same aqueous dispersion containing 15% by weight of benzyl alcohol and 1.5% by weight of nonionic surfactant as used in Example 2 for 20 minutes to be shrunk, washed with water, dried and adhered with 15% by weight of polyurethane, and the piled surface was buffed to obtain suede-like artificial leathers. The area shrinking percentages of the pile fabrics in the shrinking treatment by the benzyl alcohol aqueous dispersion were 22–24%.

Physical properties of the above obtained artificial leathers were substantially the same as those of artificial leather of sample No. 11-1-3 shown in Table 10 (Example 4). The length of naps and the appearance, touch and chalk mark property of the resulting artificial leathers are shown in the following Table 15.

Table 15

| Sample No. | Pile knitted fabric No. | Length of nap (mm) | Appearance | Touch | Chalk mark property |
|---|---|---|---|---|---|
| 22-1 | 22 | 0.15 | Naps are short, and knitted pattern of substrate appears. | Soft, but flat touch | o |
| 23-1 | 23 | 0.2 | Naps are relatively short, but knitted pattern of substrate hardly appears. | ◎ | ◎ |
| 24-1 | 24 | 0.7 | Naps are fairly long, and knitted pattern of substrate does not appear. | ◎ | ◎ |
| 25-1 | 25 | 1.9 | Naps are long, and knitted pattern of subtrate does not appear. | ◎ | ◎ |
| 26-1 | 26 | 3.0 | Naps are long, and knitted pattern of substrate does not appear. Some naps were entangled. | ◎ | ◎ |
| 27-1 | 27 | 3.8 | Naps are too long and entangled. The artificial leather is poor in the quality. | ◎ | o |

EXAMPLE 11

Artificial leathers were produced in substantially the same procedures as those in the production of sample Nos. 5-1-1, 7-1-4 and 9-1-1 in Example 2. However, in this Example 11, a raised tricot fabric was immersed in a 10% by weight aqueous solution of partially saponified polyvinyl alcohol having an average molecular weight of 500 and a saponification degree of 88% before the impregnation with polyurethane, squeezed so that the aqueous solution would adhere to the fabric in an amount of 100% by weight based on the weight of the fabric, and dried completely at 80° C. Then, the thus treated fabrics were impregnated with the polyurethane solution, and the polyurethane was coagulated in the same manner as described in Example 2, except that the temperature of the coagulation bath was 70° C. Thereafter, the fabric was washed thoroughly in hot water at 70° C. to dissolve and remove the polyvinyl alcohol, and then dried.

Physical properties and appearance of the resulting artificial leathers (sample Nos. 5-1-1′, 7-1-4′ and 7-1-1′) are shown in the following Table 16.

It can be seen from Table 16 that, when raised tricot fabric was treated with polyvinyl alcohol before the impregnation with polyurethane, the flexibility, appearance, touch and chalk mark property of the resulting artificial leather can be more improved.

Further, observation of the resulting artificial leather by an electron microscope showed that there were a large amount of spaces between the fibers of the substrate and the porous polyurethane.

Table 16

| Sample No. | Thickness (mm) | Apparent density ($g/cm^3$) | Flexibility (g . cm) | Appearance | Touch | Chalk mark property |
|---|---|---|---|---|---|---|
| 5-1-1′ | 0.79 | 0.32 | 0.301 | o | o | ◎ |
| 7-1-4′ | 0.78 | 0.34 | 0.250 | ◎ | ◎ | ◎ |
| 9-1-1′ | 0.71 | 0.38 | 0.251 | ◎ | ◎ | ◎ |

What is claimed is:

1. A method for manufacturing an artificial leather having a suede-like texture, which comprises the steps of immersing (1) a fabric selected from the group consisting of pile woven fabrics, raised woven fabrics, pile knitted fabrics and raised knitted fabrics, said fabric consisting of a substrate having piles projecting therefrom and uniformly distributed over the entire surface of the substrate at a high density, said piles having a length of 0.5 to 4.0 mm, said piles consisting essentially of composite filaments consisting of synthetic polymers having mutually low adhesive affinity to each other, said composite filaments in transverse cross-section consisting of at least three integral layers (A) of one polymer wherein said layers diverge from each other substantially radially in the outward direction and extend to the perimeter of the filament and the spaces between said layers are filled with either segments (B) of another polymer or concave segments (B′) of said another polymer the concavities of which are filled with segments (C) of a different polymer, wherein all of the polymers extend to the perimeter of the filament, in (2) an aqueous solution or emulsion of chemical effective to swell said polymers and to shrink said fabric, at a temperature of from higher than 5° C. to 120° C., until said fabric is reduced from 10 to 40% in area and said composite filaments are fibrillated, then impregnating said fabric with a solution or an emulsion of a substantially microporous synthetic polymer so as to impregnate said fabric with from 3 to 40 percent by weight of said substantially microporous synthetic polymer, based on the weight of said fabric, then coagulating said substantially microporous synthetic polymer, then buffing said piles to transform same to napped piles consisting of uniformly dispersed separate very fine fibrils of (A) and (B) or (A), (B') and (C) having a nap fibril denier of from 0.05 to 1 denier and a nap fibril length of from 0.2 to 3.0 mm.

2. The method as claimed in claim 1, wherein after said immersing step and before said impregnating step, said fabric is impregnated or coated with an aqueous solution of water-soluble substance, and after said fabric has been impregnated with said substantially microporous synthetic polymer, said water-soluble substance is removed from said fabric.

3. The method as claimed in claim 2 wherein said water-soluble substance is applied on said fabric in an amount of from 3 to 30% by weight based on the weight of said fabric, and said water-soluble substance is selected from the group consisting of polyvinyl alcohol, carboxymethyl cellulose, gelatin, starch and methyl cellulose.

4. The method as claimed in claim 2 wherein the amount of said water-soluble polymer deposited on said fabric is from 3 to 30% by weight, based on the weight of said fabric.

5. The method as claimed in claim 1, wherein said coagulating step is performed by heating said fabric impregnated with said solution or emulsion of substantially mircoporous synthetic polymer at from 60° to 150° C. to evaporate the liquid.

6. The method as claimed in claim 1, wherein said coagulating step is performed by immersing said fabric impregnated with said solution or emulsion of substantially microporous synthetic polymer in a coagulation bath at a temperature of 10° to 90° C., said coagulation bath being selected from the group consisting of water, a mixture of dimethylformamide and water, and an aqueous solution of an inorganic salt.

7. The method as claimed in claim 1 in which said composite filaments are made of a combination of polymers selected from the group consisting of (1) polyamide and polyester, (2) polyamide and polyolefin, (3) polyester and polyolefin, (4) polyester and polyolefin, (5) polyester and polyacrylonitrile, and (6) polyamide and polyacrylonitrile.

8. The method as claimed in claim 1, in which said composite filaments consist of segments A and segments B, and segments A consist of from 10 to 50% of the cross-sectional area of said composite filaments.

9. The method as claimed in claim 1, in which said composite filaments consist of segments A, segments B' and segments C, segments A consist of from 10 to 30% of the cross-sectional area of said composite filaments, and segments C consist of from 5 to 40% of the cross-sectional areas of said composite filaments.

10. The method of claim 1, wherein in said immersing step, said fabric is reduced at least 20% in area.

11. The method of claim 1 wherein said chemical is selected from the group consisting of benzyl alcohol, phenol, dimethyl-formamide, nitrobenzene, o-chlorophenol, xylene, toluene and benzene, and said aqueous solution or emulsion of said chemical is at a temperature of 10° to 120° C. and the concentration of said chemical is more than 0.1%.

12. The method of claim 11 wherein said fabric is a raised tricot fabric.

13. The method of claim 1 wherein said substantially microporous synthetic polymer is selected from the group consisting of polyurethane, polyamide, polyvinyl chloride, acrylic polymer, acrylonitrile-butadiene rubber, and styrene-butadiene rubber.

14. The method of claim 12 wherein the amount of said substantially microporous polymer impregnated in said fabric is from 5 to 30%, based on the weight of said fabric.

15. The method of claim 12 wherein the amount of said substantially microporous polymer impregnated in said fabric is from 10 to 25%, based on the weight of said fabric.

* * * * *